US008833875B2

(12) United States Patent
Arslankiray et al.

(10) Patent No.: US 8,833,875 B2
(45) Date of Patent: Sep. 16, 2014

(54) WINE PRESENTER

(75) Inventors: Ziya Arslankiray, Tekirdag (TR); Phelan Miller, Seward, AK (US); Laura Ringemann, Aliso Viejo, CA (US); Andrew Roberson, Long Beach, CA (US)

(73) Assignee: BSH Home Appliances Corporation, Irvine, CA (US)

( * ) Notice: Subject to any disclaimer, the term of this patent is extended or adjusted under 35 U.S.C. 154(b) by 0 days.

(21) Appl. No.: 13/335,112

(22) Filed: Dec. 22, 2011

(65) Prior Publication Data

US 2013/0162133 A1 Jun. 27, 2013

(51) Int. Cl.

| | |
|---|---|
| ***A47F 3/04*** | (2006.01) |
| ***A47B 96/04*** | (2006.01) |
| ***A47B 73/00*** | (2006.01) |

(52) U.S. Cl.
USPC ..... 312/116; 312/408; 211/74

(58) Field of Classification Search
USPC ..... 312/116, 401, 408; 211/74
See application file for complete search history.

(56) References Cited

U.S. PATENT DOCUMENTS

| | | | | | |
|---|---|---|---|---|---|
| 2,527,796 | A | * | 10/1950 | Clute | 211/74 |
| 3,870,155 | A | * | 3/1975 | Galloway | 211/74 |
| 4,285,449 | A | * | 8/1981 | Campos | 294/32 |
| 4,482,065 | A | * | 11/1984 | Altemose | 211/74 |
| 4,515,334 | A | * | 5/1985 | Horne | 248/146 |
| 5,472,098 | A | * | 12/1995 | Ho | 211/2 |
| 5,848,534 | A | * | 12/1998 | Stauffer | 62/91 |
| D543,078 | S | * | 5/2007 | Davalos | D7/701 |
| D560,447 | S | * | 1/2008 | Breen et al. | D7/619.1 |
| D568,697 | S | * | 5/2008 | Allen | D7/708 |
| 7,380,410 | B2 | * | 6/2008 | Rand et al. | 62/302 |
| D603,228 | S | * | 11/2009 | Frentzel | D7/705 |
| 2004/0160151 | A1 | * | 8/2004 | Collins et al. | 312/404 |
| 2005/0211648 | A1 | * | 9/2005 | Haller et al. | 211/75 |
| 2007/0228909 | A1 | * | 10/2007 | Hwang et al. | 312/408 |
| 2009/0152219 | A1 | * | 6/2009 | Brida | 211/49.1 |

FOREIGN PATENT DOCUMENTS

| | | | |
|---|---|---|---|
| FR | 2538233 | * | 6/1984 |
| FR | 2917069 | * | 12/2008 |

* cited by examiner

*Primary Examiner* — Darnell Jayne
*Assistant Examiner* — Timothy M Ayres
(74) *Attorney, Agent, or Firm* — James E. Howard; Andre Pallapies

(57) ABSTRACT

A wine presenter is provided for presenting one or more bottles of wine. The wine presenter has a base portion configured to support the wine presenter, a foot portion operatively coupled to a bottom side of the base portion and configured to rest the wine presenter on a surface, and an elongated portion having a bottom end, a top end, a front side, and a back side. The elongated portion is operatively coupled to the base portion at the bottom end and extends in an orthogonal direction from the base portion and the elongated portion has one or more grooves configured to hold at least a portion of a wine bottle. The wine presenter is configured to hold one or more wine bottles on both the front side and the back side of the elongated portion of the wine presenter.

24 Claims, 5 Drawing Sheets

WINE PRESENTER

BACKGROUND AND SUMMARY

Currently, many wine refrigerators have storage units and doors consisting of mainly glass so that someone can look in and see the contents of the refrigerator without opening the door. In many refrigerators, the shelving units hold the wine bottles in some fashion. In some examples, the shelving units may also have one or more wine racks for propping up the bottle of wine for display.

FIG. 1 shows an example of a related art wine rack unit 100. The wine rack unit 100 has a front portion 101, a body portion 102, and a foot portion 103. As can be seen in FIG. 1, a wine bottle 110 rests in the wine rack unit 100 and is held into place by virtue of the foot portion 103. As can also be seen in FIG. 1, the neck portion 110*a* of the bottle 110 hangs freely past the front portion 101 and an upper end of the base portion 110*b* sits on the front portion 101 so that the bottle 110 is propped upwards.

The design shown in FIG. 1 advantageously secures the bottle in an upright position. But, when an entire wine rack is designed in this manner, the number of bottles that can be positioned adjacent to each other for display is limited to the overall girth of the bottle. That is, when the wine rack sits in a shelf of a wine refrigerator, the bottles can only be placed in the manner shown in FIG. 1 for display. Thus, when several bottles are used in a wine rack of this design, the number of bottles is limited by the girth of each bottle.

Thus, there is a need for a wine presenter that can efficiently hold more bottles of wine for presentation.

A bottle presenter is described herein that is configured to hold one or more bottles. The bottle presenter has a base portion configured to support the bottle presenter, a foot portion operatively coupled to a bottom side of the base portion and configured to rest the bottle presenter on a surface, and an elongated portion having a bottom end, a top end, a front side, and a back side. The elongated portion is operatively coupled to the base portion at the bottom end and extends, e.g., in an orthogonal direction from the base portion. The elongated portion may have one or more grooves configured to hold at least a portion of a bottle. The bottle presenter is configured to hold one or more bottles on both the front side and the back side of the elongated portion of the bottle presenter.

Another aspect relates to a wine shelf configured to hold one or more wine bottles. The wine shelf has a body portion, a foot portion located at an end of the body portion and configured to hold a bottom end of the one or more wine bottles, and a wine rack configured to hold one or more wine bottles. The wine rack has a base portion configured to affix the wine rack to the body portion of the wine shelf, a foot portion operatively coupled to a bottom side of the base portion and configured to lock the wine rack into the wine shelf, and an elongated portion having a bottom end, a top end, a front side, and a back side. The elongated portion is operatively coupled to the base portion at the bottom end and extends in an orthogonal direction from the base portion and the elongated portion has one or more grooves configured to hold at least a portion of a bottle. The wine rack is configured to hold one or more bottles on both the front side and the back side of the elongated portion of the wine rack.

Yet another aspect relates to a refrigerator configured to hold one or more bottles and having a storage area having one or more shelving units, and a door configured to have a transparent body thereby allowing contents stored in the storage area to be visible when the door is closed. The one or more shelving units has a body portion, a foot portion located at an end of the body portion and configured to hold a bottom end of the one or more bottles, and a bottle presenter configured to hold one or more wine bottles. The bottle presenter has a base portion configured to affix the bottle presenter to the body portion of the one or more shelving units, a foot portion operatively coupled to a bottom side of the base portion and configured to lock the bottle presenter into the one or more shelving units, and an elongated portion having a bottom end, a top end, a front side, and a back side. The elongated portion is operatively coupled to the base portion at the bottom end and extends in an orthogonal direction from the base portion and the elongated portion has one or more grooves configured to hold at least a portion of a bottle. The bottle presenter is configured to hold one or more bottles on both the front side and the back side of the elongated portion of the bottle presenter.

In a non-limiting, example implementation the one or more grooves in the elongated portion is configured to hold the bottle around a neck portion of the bottle, the neck portion being smaller in circumference compared to a base portion of the bottle.

In another non-limiting, example implementation holding the bottle around the neck portion allows the bottle presenter to efficiently position the one or more bottles on each side of the bottle presenter thereby increasing a total number of bottles that can be held by the bottle presenter.

In yet another non-limiting, example implementation the bottle presenter is configured to be affixed to a shelving unit, the shelving unit optionally housed in a storage unit.

In another non-limiting, example implementation the bottle presenter is a wine rack configured to hold one or more wine bottles.

In yet another non-limiting, example implementation the one or more grooves comprise milled semi-circles configured to nest a neck of a bottle in position in the bottle presenter.

In another non-limiting, example implementation the elongated portion is more than twice in length compared to the base portion.

In yet another non-limiting, example implementation the base portion is configured to be partially open so that at least a portion of a wine bottle can rest within the openings of the base portion of the wine shelf.

DETAILED DESCRIPTION OF THE TECHNOLOGY

Figure 2A:
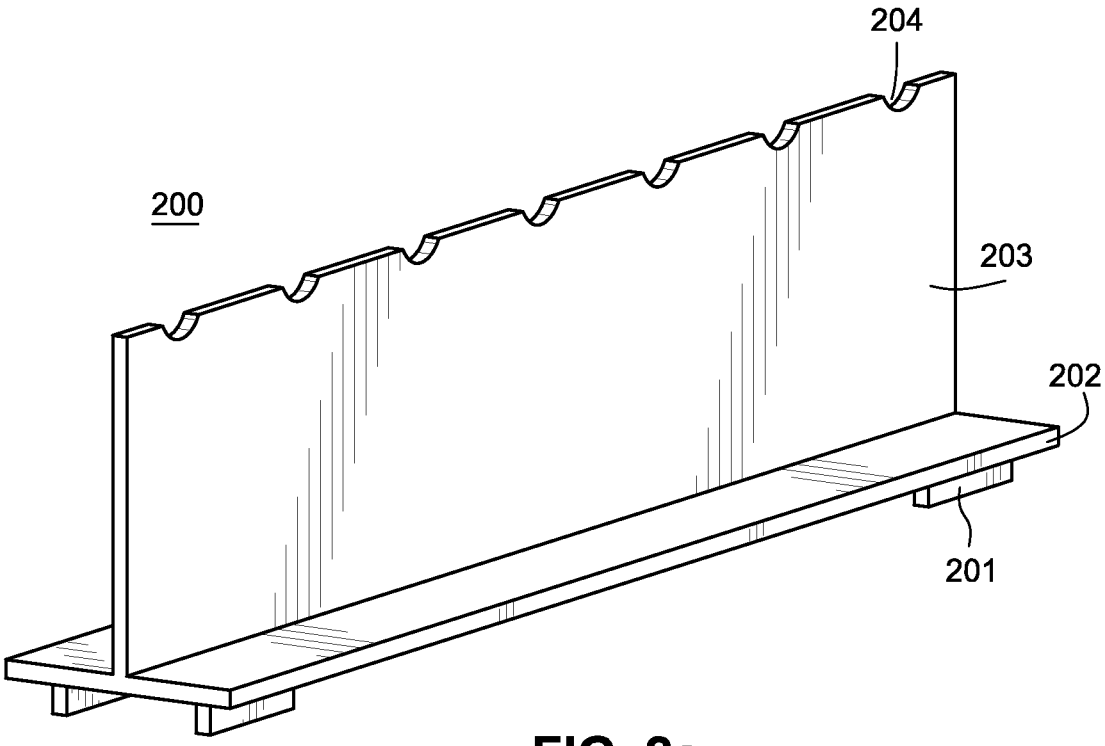
FIGS. 2*a-e* show example diagrams of a wine presenter according to the present technology.

FIGS. 2*a-e* show example diagrams of an exemplary wine presenter 200. FIG. 2*a* shows a perspective view of the wine presenter 200. The wine presenter 200 can have feet 201, a base portion 202, an elongated portion 203, and one or more grooves 204. The feet 201 can be configured to allow the wine presenter 200 to sit on a surface or can also be configured to allow the wine presenter 200 to be locked into, or otherwise engage with, a shelving unit, for example. The base portion 202 supports the wine presenter 200 and serves as a bridge between the feet 201 and the elongated portion 203.

In this example, the elongated portion 203 has one or more grooves 204 in a top side of the elongated portion 203. The elongated portion 203 can include, for example, extruded aluminum having milled semi-circles comprising the grooves 204. Although not limited to this example, the grooves 204 are designed to hold one or more bottles at around a neck portion of the bottle. The implementation of this design in a wine presenter is advantageous because it allows the ability to store wine bottles on each side of the wine presenter thereby increasing the number of bottles available on each shelf for presentation.

Figure 2B:
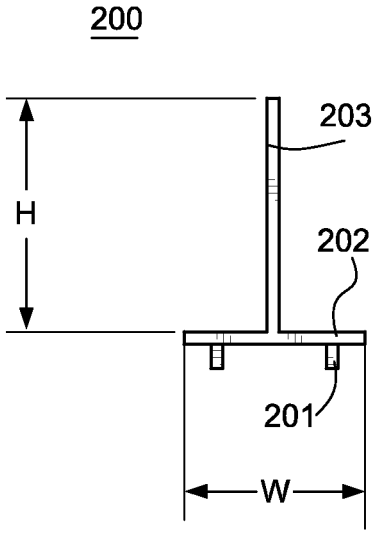

FIG. 2*b* shows a side view of the wine presenter 200. As can be seen in this view, the wine presenter 200 is capable of resting bottles on both sides of the elongated portion 203. The elongated portion 203 is also positioned near the middle of the base portion 202 and can be configured to be of any length. In this example shown in FIG. 2*b*, the wine presenter 200 can be designed so that a height H of the elongated portion 203 is more than twice a width W of the base portion 202. Of course, the design of the wine presenter 200 is in no way limited to this example and can be designed with other dimensions. For example, a wine presenter with a shorter elongated portion 203 will result in bottles not being propped up as high compared to a wine presenter 200 having a longer elongated portion 203. It should be appreciated that the height H allows for the bottle 110 to be presented at the right height H and also allows the presenter 200 to be stored in shelving units in a manner that does not interfere with shelving units.

Figure 2C:
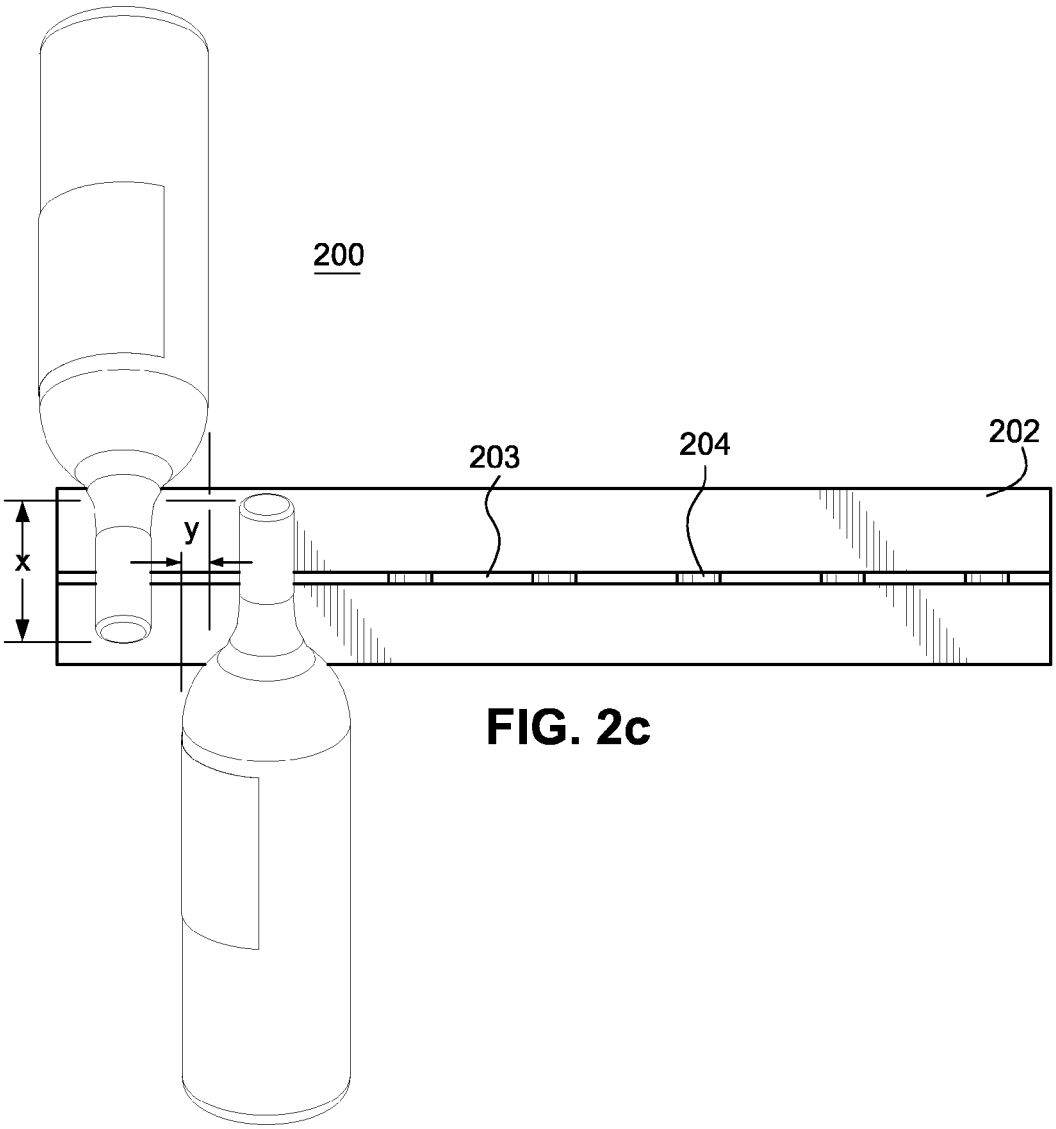
Figure 2D:
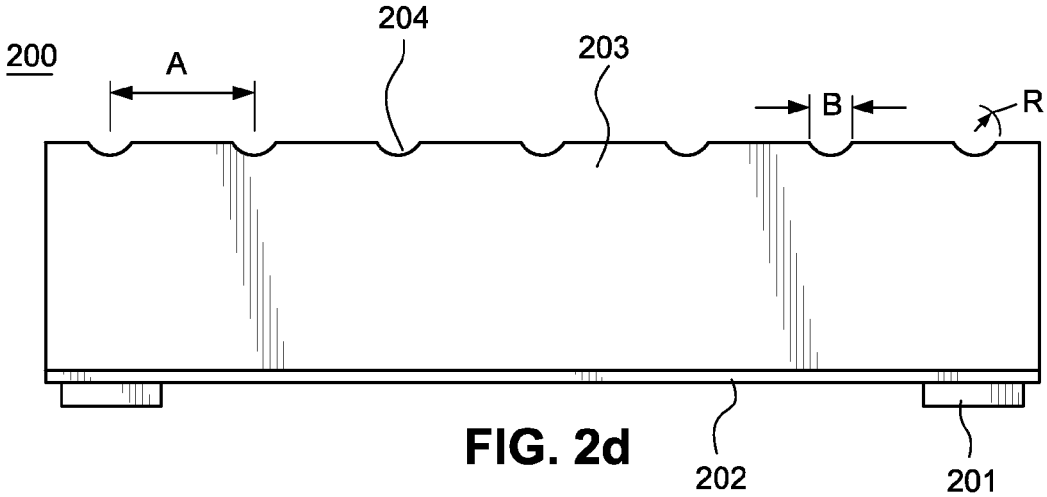

FIGS. 2*c* and 2*d* show views from the top and front/back perspective, respectively. As can be seen in FIGS. 2*c* and 2*d*, the grooves 204 are equally spaced along a top of the elongated portion 203. Of course, this arrangement of the grooves 204 is in no way limited to this example and the grooves 204 can be positioned in several other configurations.

Also shown in FIG. 2*c* are overlap regions where bottles 110 overlap each other. As can be seen in FIG. 2*c*, bottles 110 overlap along a width of the wine presenter 200 where the necks of the bottles 110 rest in the grooves 204. The overlap along the width in FIG. 2*c* is shown in the overlapping portion X. The bottles 110 also overlap along a length of the presenter 200 where the bottles 110 increase in circumference at the base portion 110*b* of the bottle 110. The overlap along the length in FIG. 2*c* is shown in the overlapping portion Y. It should be appreciated that in certain example embodiments the overlapping portions are in relation to a standard 750 mL wine bottle, but the overlap may vary with different size bottles.

Figure 1:
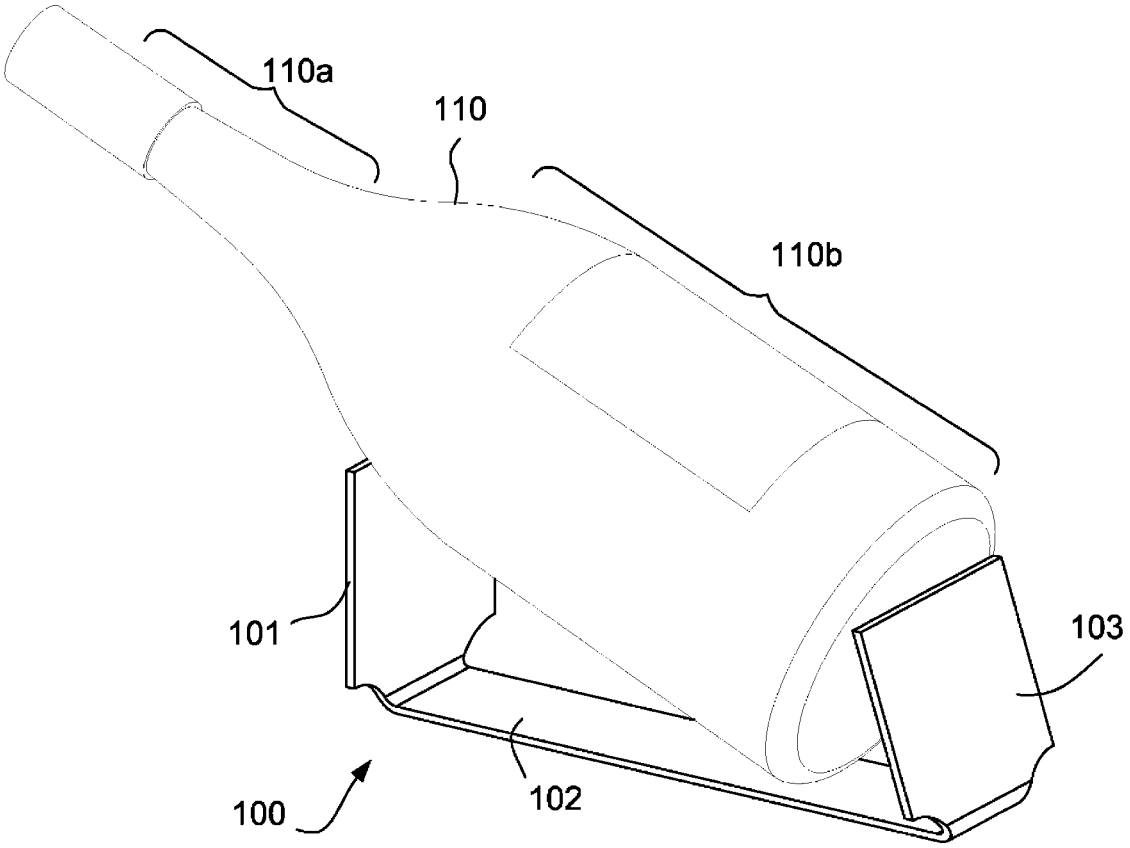
FIG. 1 (RELATED ART)
FIG. 1 is an example diagram of a related art wine rack.

In contrast to the related art shown in FIG. 1, the overlap shown in FIG. 2*c* is advantageous in that it allows for more bottles 110 to be placed in the wine presenter 200. That is, because the bottles 110 rest on the presenter 200 at the neck 110*a* of the bottle 110, and because bottles 110 can be placed on both sides of the presenter 200, the bottles overlap for a portion in width and/or length thereby allowing for more bottles to be placed in the presenter 200.

As explained above, FIG. 2*d* shows a front/back perspective of the wine presenter 200. The groove spacing A is the distance between the center of each respective groove 204. In certain embodiments, the groove spacing A can be in the range of about 60 mm to about 66 mm, preferably about 62 mm to about 64 mm, and more preferably about 62.5 mm. The semi-circle grooves 204 are configured to nest a neck of the bottle 110.

The groove width B represents the distance between each opening edge of the groove 204. In certain embodiments, the groove width B can be in the range of about 22 mm to about 28 mm, preferably about 24 mm to about 26 mm, and more preferably about 24.49 mm. The grooves 204 also have a groove radius R that represents the radius of the semi-circle if the semi-circle were a complete circle. In certain embodiments, the groove radius R can be in the range of about 15 mm to about 20 mm, preferably about 16.5 mm to about 18.5 mm, and more preferably about 17.5 mm.

Figure 2E:
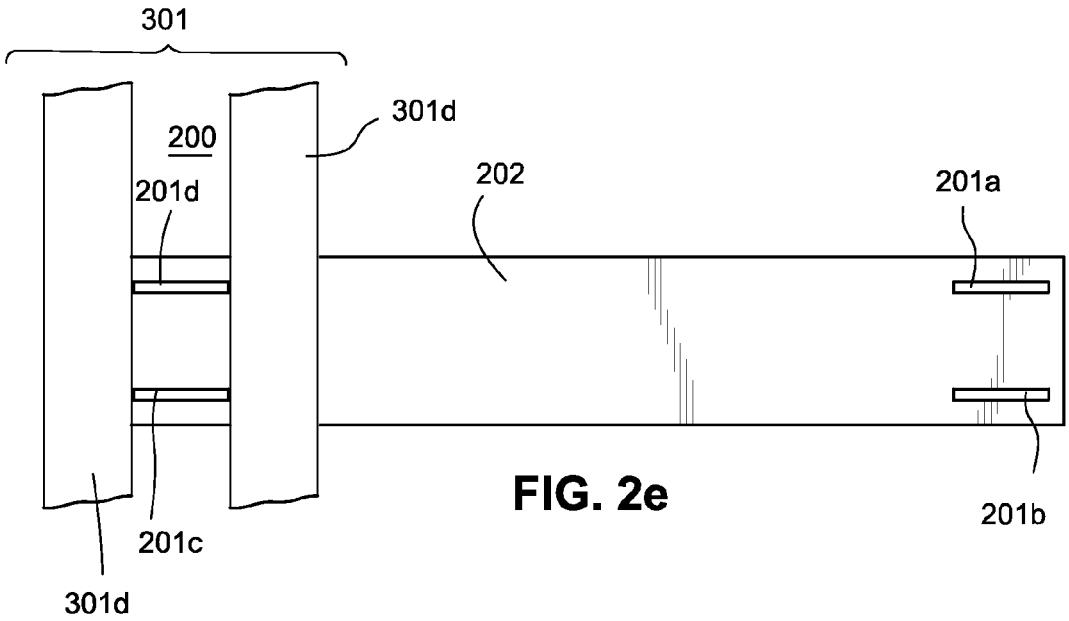

FIG. 2*e* shows a view from a bottom of the wine presenter 200. As can be seen in FIG. 2*e*, the base portion 202 of the wine presenter 200 has feet 201*a-d* positioned proportionally so that the wine presenter 200 can sit on a surface and/or lock into or engage with a shelving unit. In this example, the presenter 200 has four feet 201*a-d*, but in no way is limited to this number and can be designed to have less or more. The feet 201*a-d* can also be positioned in various other configurations along the bottom side of the base portion 202.

Figure 3:
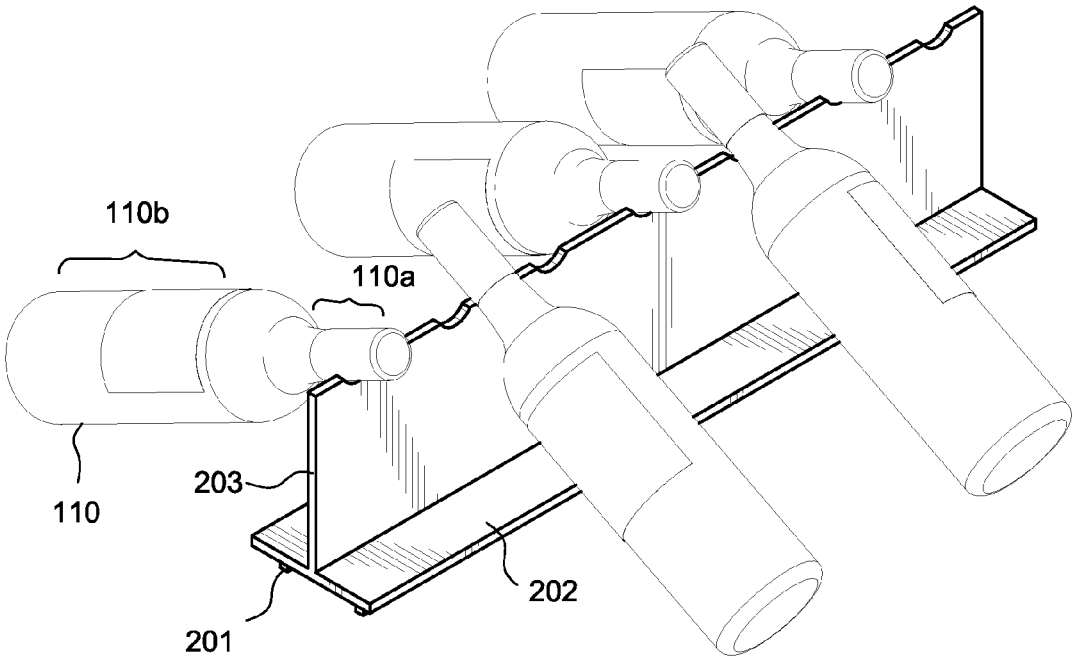
FIG. 3 shows a diagram of the wine presenter used on a flat surface.

FIG. 3 shows a diagram of the wine presenter 200 having one or more wine bottles 110 held in the wine presenter 200. As can be seen in FIG. 3, a neck portion 110*a* rests in a groove 204 of the wine presenter 200 (rather than hanging freely as seen in FIG. 1). Holding the wine bottle 110 in this manner allows for more efficient placement of the wine bottles 110 and wine bottles 110 can now be placed on both sides of the wine presenter 200.

FIG. 1, by contrast, rests the bottle 110 at the base portion 110*b* so the bottles 110 will be spaced apart depending upon the given circumference of the bottle 110, and will allow no overlap between bottles. With the wine presenter 200 shown in FIG. 3, the ease of viewing is the same as the presentation shown in FIG. 1, but now bottles 110 can be placed on both sides of the presenter 200 thereby allowing a greater number of bottles to be held and displayed by the presenter 200.

Figure 4:
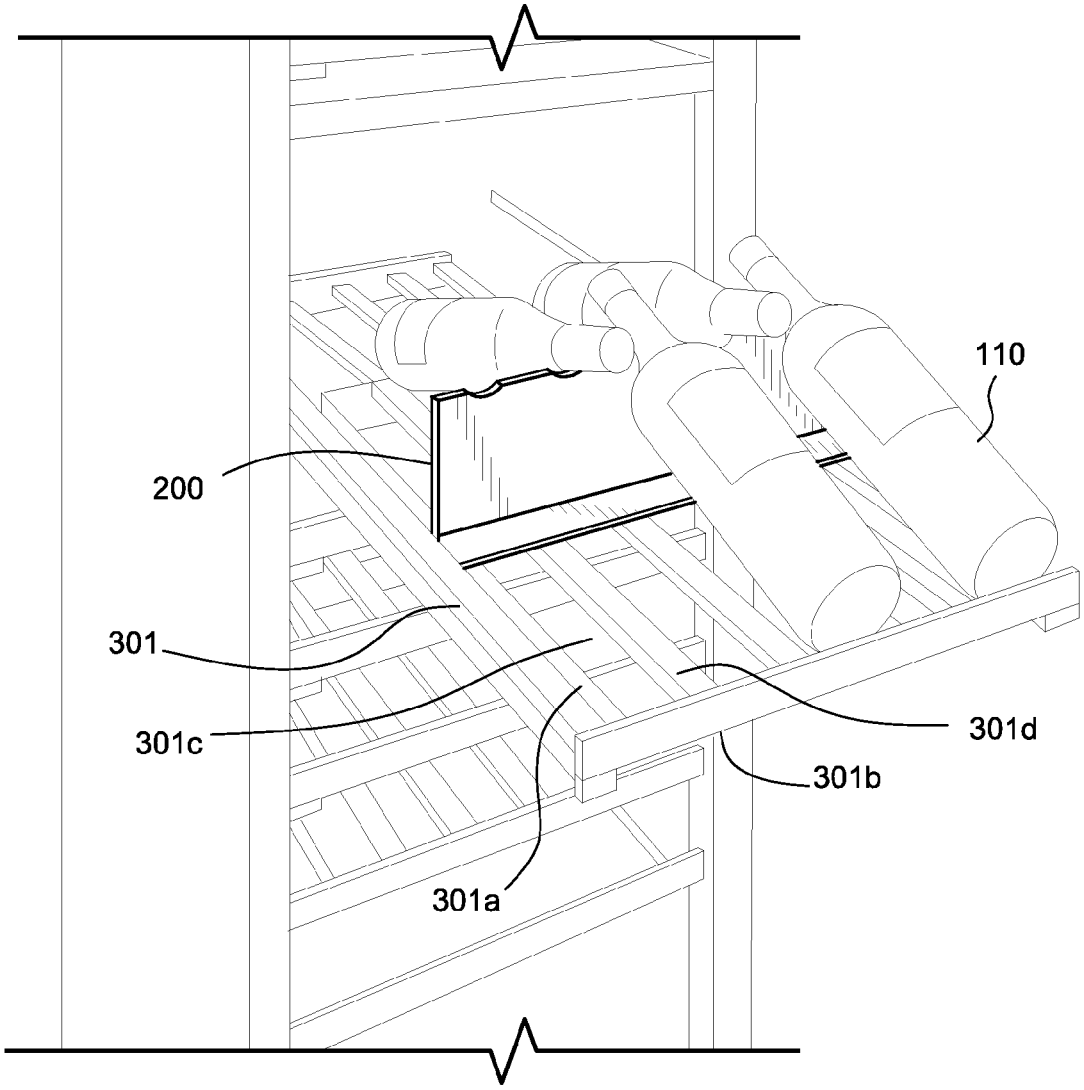
FIG. 4 shows a diagram of the wine presenter in a shelving unit inside a wine refrigerator.

FIG. 4 shows an example diagram of a wine refrigerator 300. The wine refrigerator 300, in this example, has multiple shelving units 301. Each shelving unit has a body portion 301*a*, an edge portion 301*b*, at least one opening portion 301*c*, and at least one bar portion 301*d*. Of course, the design of the shelving unit 301 is not limited to this example and can have, for example, no opening portions 301*c* or bar portions 301*d* so that the body portion 301*a* is one flat surface.

The shelving units 301 can be configured to hold one or more wine presenters 200. In this example, the wine presenter 200 is positioned in the middle of the shelving unit 301 thereby allowing wine bottles to be held on both sides (e.g., front and rear sides) of the presenter 200 in the shelving unit 301. The wine presenter 200 can be held in place in the shelving unit 301 by "locking" in the presenter 200 using feet 201. That is, the feet 201 can lock into the bar portions 301*d* around each side of the bar portions 301*d* thereby holding the presenter 200 in the shelving unit 301. Of course, the presenter 200 can be affixed to the shelving unit 301 in any manner and does not have to be locked in using the feet 201. In the illustrated example, the presenter can simply be located in a predetermined position relative to the shelving unit 301.

As explained above, the shelving units 301 are configured to have one or more edge portions 301*b*. The edge portions 301*b* allow the base portion 110*b* of the wine bottles 110 to rest against the edge portions 301*b* (possibly assisted by gravity due to the angled mounting of the shelving unit) thereby allowing the bottles 110 to sit in the shelf while remaining propped up for display. Similarly, the openings 301*c* in the body portion 301*a* allow at least a portion of the wine bottles 110 to protrude below the body portion 301*a* and rest against each of the bar portions 301*d*, for stability.

FIG. 2*e* shows the presenter 200 locking into, engaging with, or located relative to a shelving unit 301. As can be seen in FIG. 2*e*, the feet 201*a-d* are positioned between the bars 301*d* and of a width that allows the feet 201*a-d* to hold the presenter 200 in the shelving unit 301 via friction, for example. It should be appreciated that a crossbar may also be used and placed between feet 201*a-d*. For example, feet 201*a* and 201*d* sit on one side of the crossbar while feet 201*b* and 201*c* sit on the other side of the crossbar. The effect of gravity on the presenter 200 allow the feet 201 to lock into, or engage with, the crossbar. Likewise, the feet 201*a-d* can be spaced closer to each other in the width direction so that they "snap" onto the crossbar thereby "gripping" the crossbar.

Of course, the "locking" can be implemented in other ways. For example, magnets or some other locking mechanism may be used to affix the presenter 200 to the shelf 301. There could also be slats affixed on the bars 301*d* that prevent the feet 201*a-d* from moving downward on the shelf 301.

While the technology has been described in connection with what are presently considered to be the most practical and preferred examples, it is to be understood that the technology is not to be limited to the disclosed examples, but on the contrary, is intended to cover various modifications and equivalent arrangements.

What is claimed is:

1. A bottle presenter configured to support one or more bottles, comprising:

a base portion configured to support the bottle presenter;

a foot portion operatively coupled to a bottom side of the base portion and configured to rest the bottle presenter on a surface; and an elongated portion having a bottom end, a top end, a front side, and a back side, and configured to rest a bottle, at a neck portion of the bottle, at a height of the elongated portion and to elevate the bottle at the neck portion at the height so that the bottle is elevated at an angle allowing a base part of the bottle to be readily viewable from a position in a plane positioned opposite the front side of the elongated portion or opposite the back side of the elongated portion, wherein the elongated portion is operatively coupled to the base portion at the bottom end and extends from the base portion, the elongated portion having one or more grooves on the top end configured to support at least a portion of the bottle, and the bottle presenter being configured to support one or more bottles on both the front side and the back side of the elongated portion of the bottle presenter, and wherein the bottle presenter is configured to elevate the bottle at an angle causing a top of the neck portion of the bottle to sit above an upper edge of a label portion of the bottle in the height direction while a portion of the base part of the bottle is positioned below or level with the base portion of the bottle presenter.

2. The bottle presenter of claim 1, wherein the one or more grooves in the elongated portion are configured to support the bottle around the neck portion of the bottle, the neck portion being smaller in circumference compared to a base part of the bottle.

3. The bottle presenter of claim 2, wherein holding the bottle around the neck portion allows the bottle presenter to efficiently position the one or more bottles on each side of the bottle presenter thereby increasing a total number of bottles that can be held by the bottle presenter.

4. The bottle presenter of claim 1, wherein the bottle presenter is configured to be affixed to or engage with a shelving unit.

5. The bottle presenter of claim 1, wherein the bottle presenter is a wine rack configured to support one or more wine bottles.

6. The bottle presenter of claim 1, wherein the one or more grooves comprise milled semi-circles configured to rest the neck of a bottle in position in the bottle presenter.

7. The bottle presenter of claim 1, wherein the height of the elongated portion is at least two times greater than a width of the base portion.

8. The bottle presenter of claim 1, wherein the elongated portion is directly connected to the base portion.

9. The bottle presenter of claim 1, wherein the height of the elongated portion is configured relative to a length of the bottle.

10. A wine shelf configured to support a plurality of wine bottles, comprising:

a body portion;

an edge portion located at an end of the body portion, the edge portion configured to hold a bottom end of each of the wine bottles; and a bottle presenter configured to support the wine bottles, wherein the bottle presenter comprises:

a base portion configured to engage the body portion, a foot portion operatively coupled to a bottom side of the base portion and configured to engage the bottle presenter to the wine shelf, and an elongated portion having a bottom end, a top end, a front side, and a back side, and configured to rest the wine bottles, at neck portions of the wine bottles, at a height of the elongated portion and to elevate the wine bottles at the neck portions at the height so that the wine bottles are elevated at an angle allowing a base part of at least some of the bottles to be readily viewable from a position in a plane positioned opposite the front side of the elongated portion, the front side of the elongated portion being positioned to face the edge portion of the wine shelf, wherein the elongated portion is operatively coupled to the base portion at the bottom end and extends from the base portion, the elongated portion having a plurality of grooves on the top end configured to respectively support at least a portion of a respective wine bottle, and the bottle presenter being configured to support the wine bottles on both the front side and the back side of the elongated portion of the bottle presenter, wherein the bottle presenter is configured to elevate the wine bottles at an angle causing a top of each neck portion of the wine bottles to sit above an upper edge of a respective label portion of the wine bottles in the height direction while respective portions of the base parts of the wine bottles are positioned below or level with the base portion of the bottle presenter.

11. The wine shelf of claim 10, wherein the plurality of grooves in the elongated portion comprise milled semi-circles configured to support a respective bottle around the neck portion of the bottle in position in the bottle presenter, the neck portion being smaller in circumference compared to the base part of the bottle.

12. The wine shelf of claim 10, further comprising a crossbar positioned in the body portion of the wine shelf and configured to affix the bottle presenter with the wine shelf, wherein the bottle presenter is configured to be removable from the wine shelf and used as a rack on a support surface.

13. The wine shelf of claim 12, wherein the foot portion of the bottle presenter has a plurality of feet that rest on each side of the crossbar so that the plurality of feet in combination with the effect of gravity engage the bottle presenter with the wine shelf.

14. The wine shelf of claim 10, wherein the wine shelf is configured to be mounted in a storage housing.

15. The wine shelf of claim 10, wherein the bottle presenter is configured such that the wine bottles partially overlap each other at the neck portions of the bottles.

16. The wine shelf of claim 10, wherein the base portion is configured to be partially open so that at least portions of the wine bottles can rest within the openings of the base portion of the wine shelf.

17. A refrigerator configured to hold a plurality of bottles, comprising:

a housing having a depth and a width, the housing including a storage area configured to accommodate one or more shelving units; and a door mounted to the housing and configured to permit access to the storage area, the door extending along a width of the housing and having a transparent body thereby allowing contents stored in the storage area to be visible when the door is closed, each of the one or more shelving units comprising:

a body portion, an edge portion located at an end of the body portion, the edge portion configured to support bottom ends of the plurality of bottles, and a bottle presenter configured to support the bottles, wherein the bottle presenter comprises:

a base portion configured to engage the body portion, a foot portion operatively coupled to a bottom side of the base portion and configured to engage the bottle presenter to the body portion, and an elongated portion having a bottom end, a top end, a front side, and a back side, and configured to rest the bottles, at neck portions of the bottles, at a height of the elongated portion and to elevate the bottles at the neck portions at the height so that the bottles are elevated at an angle allowing a base part of at least some of the bottles to be readily viewable through the transparent body of the door, wherein the elongated portion is operatively coupled to the base portion at the bottom end and extends from the base portion along the width of the housing, the elongated portion having a plurality grooves on the top end configured to respectively support at least a portion of a respective bottle, and the bottle presenter being configured to support the bottles on both the front side and the back side of the elongated portion of the bottle presenter in a spaced arrangement along the width of the housing, wherein the bottle presenter is configured to elevate the bottles at an angle causing a top of each neck portion of the bottles to sit above an upper edge of a respective label portion of the bottles in the height direction while respective base portions of the base parts of the bottles are positioned below or level with the base portion of the bottle presenter.

18. The refrigerator of claim 17, wherein the plurality of grooves in the elongated portion comprise milled semicircles configured to support a respective bottle around the neck portion of the bottle in position in the bottle presenter, the neck portion being smaller in circumference compared to a base part of the bottle.

19. The refrigerator of claim 17, further comprising a crossbar positioned in the body portion of a respective shelving unit and configured to affix the bottle presenter with the shelving unit, wherein the bottle presenter is configured to be removable from the shelving unit and used as a rack on a support surface.

20. The refrigerator of claim 19, wherein the foot portion of the bottle presenter has a plurality of feet that rest on each side of the crossbar so that the plurality of feet in combination with the effect of gravity engage the bottle presenter with the shelving unit.

21. The refrigerator of claim 17, wherein the bottle presenter is configured such that the neck portions of the bottles positioned on the front side of the elongated portion partially overlap with the neck portions of the bottles positioned on the back side of the elongated portion.

22. The refrigerator of claim 17, wherein the base portion is configured to be partially open so that at least portions of the bottles can rest within the openings of the base portion.

23. The refrigerator of claim 17, wherein the shelving unit is inclined in a depth direction of the housing.

24. The refrigerator of claim 23, wherein the body portion of the shelving unit extends upwardly at an angle away from the door in the depth direction of the housing such that the edge portion of the shelving unit is positioned below the base portion of the bottle presenter.

* * * * *